US012534845B2

(12) United States Patent
Li et al.

(10) Patent No.: US 12,534,845 B2
(45) Date of Patent: Jan. 27, 2026

(54) LIQUID STORAGE BOX, ADDITIVE DISPENSING APPARATUS, AND METHOD FOR IDENTIFYING ADDITIVE TYPE

(71) Applicants: QINGDAO HAIER WASHING MACHINE CO., LTD., Shandong (CN); HAIER SMART HOME CO., LTD., Shandong (CN)

(72) Inventors: Wenwei Li, Shandong (CN); Jun Wu, Shandong (CN); Guangfeng Wang, Shandong (CN)

(73) Assignees: QINGDAO HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 173 days.

(21) Appl. No.: 18/264,616

(22) PCT Filed: Jan. 20, 2022

(86) PCT No.: PCT/CN2022/072851
§ 371 (c)(1),
(2) Date: Aug. 8, 2023

(87) PCT Pub. No.: WO2022/170936
PCT Pub. Date: Aug. 18, 2022

(65) Prior Publication Data

US 2024/0117559 A1 Apr. 11, 2024

(30) Foreign Application Priority Data

Feb. 9, 2021 (CN) ..... 202110176494.9
Feb. 9, 2021 (CN) ..... 202110176514.2

(51) Int. Cl.
*D06F 39/02* (2006.01)
*D06F 103/22* (2020.01)
*D06F 103/60* (2020.01)

(52) U.S. Cl.
CPC ..... *D06F 39/022* (2013.01); *D06F 2103/22* (2020.02); *D06F 2103/60* (2020.02)

(58) Field of Classification Search
CPC ..... A47L 2401/02–026; D06F 39/02–028; D06F 2103/22
See application file for complete search history.

(56) References Cited

U.S. PATENT DOCUMENTS

2010/0161143 A1 6/2010 Smith et al.
2023/0048461 A1* 2/2023 Echtermeyer ..... D06F 39/02

FOREIGN PATENT DOCUMENTS

BE 829148 A 9/1975
CN 101608388 A 12/2009
(Continued)

OTHER PUBLICATIONS

International Search Report (PCT/ISA/210) with English translation and Written Opinion (PCT/ISA/237) mailed on Apr. 24, 2022, by the Chinese Patent Office as the International Searching Authority for International Application No. PCT/CN2022/072851.

*Primary Examiner* — Spencer E. Bell
(74) *Attorney, Agent, or Firm* — Panitch Schwarze Belisario & Nadel LLP

(57) ABSTRACT

A liquid storage box, an additive dispensing apparatus, and a method for identifying an additive type. The liquid storage box is provided with a closed chamber for storing additive. At least one marking conductive component is disposed on the liquid storage box. Any one element or a combination of elements selected from a group consisting of the quantity, position, shape, and resistance of the marking conductive components provided on the liquid storage box indicates
(Continued)

correspondingly the type of additive. The identification conductive components are arranged in an accommodating portion of the additive dispensing apparatus. The identification conductive components cover the shadows of the marking conductive components disposed on different liquid storage boxes in the accommodation portion. The marking conductive component of the liquid storage box is spaced from the identification conductive component in the accommodating portion, so as to form capacitance correspondingly indicating the type of the additive.

12 Claims, 10 Drawing Sheets

(56) References Cited

FOREIGN PATENT DOCUMENTS

| | | | |
|---|---|---|---|
| CN | 103587247 | A | 2/2014 |
| CN | 105722444 | A | 6/2016 |
| CN | 107089057 | A | 8/2017 |
| CN | 109137403 | A | 1/2019 |
| CN | 113152032 | A | 7/2021 |
| CN | 215328870 | U | 12/2021 |
| EP | 4097289 | A1 | 12/2022 |
| GB | 1505274 | A | 3/1978 |
| WO | 2007027809 | A2 | 3/2007 |
| WO | 2018114360 | A1 | 6/2018 |
| WO | 2019001290 | A1 | 1/2019 |

* cited by examiner

LIQUID STORAGE BOX, ADDITIVE DISPENSING APPARATUS, AND METHOD FOR IDENTIFYING ADDITIVE TYPE

FIELD

The disclosure relates to the technical field of a laundry treatment device, in particular, to a liquid storage box, additive dispensing apparatus, and a method for identifying additive type.

BACKGROUND

At present, the dispensing apparatus matched with a washing machine is gradually emerging. The existing dispensing apparatus only meet the simple needs of users, and are far lower than the standards of high-tech products that are capable of smartly dispensing. The existing additive dispensing apparatus generally has a number of accommodations, and each of the accommodations is provided with one liquid storage box, so that the storage box for storing different types of additives can be installed one additive dispensing apparatus at the same time. Thereby the dispensing apparatus can dispense one type of additive or a combination of different types of additives.

However, for the existing additive dispensing apparatus arranged the outside, users are prone to place the storage box in a wrong position in the process of replacing the storage box. Especially due to the increase in the functions of the washing machine, the washing machine can realize to automatically dispense detergent, stubborn, color fixative, and softener. Various storage boxes are distinguished by identifiers. Users need to learn the corresponding identifiers by themselves, so it is easy to wrongly remember, or dispense wrongly.

Chinese Patent Application No. 201810617547.4 discloses a method for controlling to automatically dispense additives in a washing machines and an automatic dispensing apparatus. The automatic dispensing apparatus includes the fixed storage boxes for containing fixed types of laundry treatment agents, and the variable storage boxes for containing one type of laundry treatment agent or types of laundry treatment agents. The control method includes: performing the washing program by the washing machine, and automatically performing the dispensing process by automatic dispensing apparatus, according to the selected laundry treatment agents in the fixed storage box and/or variable storage boxes.

In the above mentioned application, the automatic dispensing apparatus can select the variable storage box, and control to dispense the laundry treatment agents contained in the variable storage box. It can be achieved to targetedly dispense the laundry treatment agents with respect to different laundry. However, the automatic dispensing apparatus disclosed cannot identify the types of additives stored in the variable storage box. The storage boxes are properly put in the correct positions by default. It is impossible to be accurately dispensed in accordance with the actual types of additives.

In view of this, the disclosure is specifically proposed.

SUMMARY

The present disclosure is to overcome the deficiencies of the prior art, and provides a liquid storage box, an additive dispensing apparatus and a method for identifying the type of additive. By utilizing the marking conductive components arranged on the liquid storage box and the identification conductive components arranged on the additive dispensing apparatus, the capacitance is formed between the two conductive components, and the type of additive in the liquid storage box can be accurately detected. During the following using process, the correct type of additive after being determined is accurately dispensed. So, the problem is solved that the existing additive dispensing apparatus cannot automatically detect whether the type of additive in the liquid storage box 1 is correct.

In order to solve the above problem, the basic solution is as follows.

A liquid storage box has a closed chamber for storing additive, and at least one marking conductive component is arranged on the liquid storage box. Any one element or a combination of elements selected from a group consisting of the quantity, position, shape, and resistance etc. of the marking conductive component on the liquid storage box indicates correspondingly the type of additive in the liquid storage box.

As a solution, the marking conductive component is an marking conductive metal sheet arranged on the liquid storage box. There is difference in the quantity, position, shape, thickness, and/or material etc. of the marking conductive metal sheet on the liquid storage box for storing different types of additives.

As a solution, the type of additive in the liquid storage box is indicated correspondingly by the position and quantity of the marking conductive metal sheet on the liquid storage box.

Preferably, the marking conductive metal sheets are arranged on the liquid storage box by means of combinations, and the different combinations of the marking conductive metal sheets correspondingly indicate different types of additives in the liquid storage boxes 1.

As a solution, the marking conductive metal sheet is arranged on an outer wall of the liquid storage box.

Alternatively, the marking conductive metal sheet is embedded in the inside of the box wall constituting the closed chamber of the liquid storage box.

Alternatively, the marking conductive metal sheet is provided on the inner surface of the box wall constituting the closed chamber of the liquid storage box 1.

As a solution, the liquid storage box has an insertion end for being connected with a dispensing apparatus. At least one protrusion is arranged on the insertion end of the liquid storage box, and is extended in an insertion direction of the liquid storage box. The marking conductive metal sheet is arranged on one protrusion or more protrusions. The marking conductive metal sheet is arranged at the end of the protrusion, and/or buried inside the protrusion.

As a solution, the insertion end of the liquid storage box has a plurality of setting positions in multiple rows and columns, and the marking conductive metal sheet is arranged on one setting position or the setting positions.

Preferably, the marking conductive metal sheet is perpendicular to the insertion direction of the liquid storage box.

As a solution, all of the identification conductive components are connected to the same first connection terminal via a connection circuit arranged in parallel. The first connection terminal is used for connecting with the second connection terminal in the corresponding accommodating portion of the additive dispensing apparatus.

Another objective of the present disclosure is to provide an additive dispensing apparatus. The additive dispensing apparatus has at least one accommodating portion for placing the liquid storage box. A plurality of identification conductive components are arranged in the accommodating portion, and all of the identification conductive components cover the projections of the identification conductive components of different liquid storage boxes on the accommodating portion. The marking conductive component of the liquid storage box is spaced apart from the identification conductive component in the accommodating portion 3, so as to form the capacitance for correspondingly indicating the type of additive in the liquid storage box.

As a solution, the identification conductive component is an identification conductive metal sheet provided in the accommodating portion. The identification conductive metal sheet is arranged on the inner wall of the accommodating portion, or embedded in the interior of the accommodating portion. The marking conductive metal sheets on the liquid storage box are arranged parallel to and spaced apart from the identification conductive metal sheets in a one-to-one relationship, and the identification conductive metal sheets are provided at the projections of the marking conductive metal sheets on the accommodating portion.

As a solution, there is a interval space between the marking conductive metal sheet and the identification conductive metal sheet. In the interval space, a box wall of the liquid storage box and/or a cavity wall of the accommodating portion are/is made of non-conductive material.

As a solution, the projection area of the marking conductive metal sheet of the liquid storage box on the surface and/or inside of the accommodating portion along a direction vertical to the marking conductive metal sheet is as the projection position.

As a solution, the accommodating portion has a bottom wall being in contact with the insertion end of the liquid storage box, and the bottom wall is provided with grooves for allowing the protrusions of the insertion ends of different liquid storage boxes to be inserted. The bottom of each of the grooves is provided with the identification conductive metal sheet perpendicular to the insertion direction of the liquid storage box.

As a solution, all the identification conductive components are respectively connected to the same second connection terminal via a connecting circuit arranged in parallel. The second connection terminal is connected with the first connection terminal arranged on the liquid storage box being inserted in the accommodating portion of the additive dispensing apparatus.

As a solution, an enhancing voltage unit is arranged on a connecting circuit to apply voltage on the capacitance formed by the identification conductive component and the marking conductive component.

As a solution, each of the identification conductive components is connected with a detection unit. The detection unit is used for detecting whether the identification conductive components constitute a capacitance and detecting the amount of the capacitance. An identification unit is used for determining the type of the additive in the liquid storage apparatus on basis of the information from each of the detection units about whether the identification conductive components constitute a capacitance and the amount of the capacitance.

The other objective of the disclosure is to provide a method for identifying the type of additive in the above-mentioned additive dispensing apparatus, which includes: inserting the liquid storage box into the accommodating portion of the additive dispensing module;

forming a capacitance between the marking conductive components on the liquid storage box and the identification conductive components at the projections on the accommodating portion;

obtaining information about whether the identification conductive components in the accommodating portion forms a capacitance, and the amount the capacitance; and determining the type of additive in the liquid storage box based on whether the identification conductive components in the accommodating portion form a capacitance and the amount of the capacitance.

Comparing with the prior art, the present disclosure has the following advantages by the above solutions.

1. By the arrangements of the marking conductive components on the liquid storage box and the identification conductive components in the additive dispensing apparatus in the present disclosure, there is a capacitance between the marking conductive components on the liquid storage box and the identification conductive components set on the projections thereof when it is determined that the liquid storage box is inserted into the accommodating portion of the additive dispensing apparatus. The type of the additive in the liquid storage box is determined according to the detection information of whether the identification conductive components form a capacitance, and the amount of the capacitance. The present disclosure can realize to automatically identify the type of additive in the liquid storage box by means of electrical detection and without contact, and it is achieved high identification efficiency and identification accuracy.

2. The marking conductive components on the liquid storage box are the conductive metal sheets. The capacitance for indicating the type of additive in the liquid storage box can be formed between the marking conductive metal sheets on the liquid storage box and the identification conductive metal sheets at the corresponding position in the accommodating portion of the dispensing apparatus, when the liquid storage box is installed in the accommodating portion. The type of additive in the liquid storage box can be determined according to the capacitance information detected. The above-mentioned structure is simple, and easy to realize. On the basis of combines of quantity, positions, thicknesses and shapes of the marking conductive metal sheets on the liquid storage box, it is realized that the type of additive in the liquid storage box is accurately identified. Thereby the type of the additive in the liquid storage box is automatically and accurately identified, which is the significant technological progress.

3. In the present disclosure, the type of additive in the liquid storage box can be accurately determined by using the capacitance information formed between the liquid storage box and the accommodating portion of the dispensing apparatus. A method for identifying the type of additive in the liquid storage box by means of the electrical detection is provided. The method is simple, and makes the arrangement of the conductive component more flexible.

The optical detection agency on the launch apparatus can accurately detect the types of additives stored in the storage box. In the subsequent use process, the correct type of additives after identification will be accurately put in accurately to effectively solve the existing additive investment apparatus It is not possible to automatically detect whether the types of additives stored in the storage box that are not available are correct.

The present disclosure is to overcome the deficiencies of the prior art, and provides a liquid storage box, an additive dispensing apparatus and a method for identifying the type of additive. By utilizing the light sensitive component arranged on the liquid storage box and the optical detection mechanism arranged on the additive dispensing apparatus, the type of additive in the liquid storage box can be accurately detected. During the following using process, the correct type of additive after being determined is accurately dispensed. So, the problem is solved that the existing additive dispensing apparatus cannot automatically detect whether the type of additive in the liquid storage box is correct.

In order to solve the above problem, the basic solution is as follows.

A liquid storage box has a closed chamber for storing additive, and at least one light sensitive component is arranged on the liquid storage box. Any one element or a combination of elements selected from a group consisting of the quantity, position, shape, and light transmission of the light sensitive component on the liquid storage box correspondingly indicates the type of additive in the liquid storage box.

As a solution, the light sensitive component is one or more light blocking parts on the liquid storage box. The liquid storage boxes with different types of additives are provided with different quantity, position, thickness, material and/or color of the light blocking part.

Preferably, the light blocking parts are arranged by means of a variety of combinations according to the position and quantity of the light blocking parts on the liquid storage box. The combinations of the light blocking parts correspondingly indicate different types of additives in the liquid storage box.

As a solution, the light blocking part is a light blocking protrusion which is protruded outward from the outer wall of the liquid storage box, or is protruded inward from the inner wall of the liquid storage box. Multiple of the light blocking protrusions are arranged linearly on the top wall or the side wall of the liquid storage box. The liquid storage boxes with different types of additives are provided with the different quantity and/or position of the light blocking protrusions.

Preferably, in the inserting direction of the liquid storage box, the light blocking part is set on a front wall of the liquid storage box, and is multiple of the light blocking protrusions being protruded outward from the front wall of the liquid storage box.

As a solution, the light sensitive component has a reflection surface. Any one element or a combination of elements selected from a group consisting of the quantity, position, and reflectivity of the light sensitive component set on the liquid storage box correspondingly indicates the type of additive in the liquid storage box.

Or, the light sensitive component is identification labels with different colors arranged on the outer wall of the liquid storage box. The reflectivity of the identification labels with different colors is different. The color of the identification label indicates correspondingly the type of additive in liquid storage box.

The other objective of the disclosure is to provide an additive dispensing apparatus, having at least one accommodating portion for installing the above liquid storage box.

There are multiple of the optical detection mechanisms in the accommodating portion, and the optical detection mechanisms cover the beaming identification areas corresponding to the light sensitive components on different liquid storage boxes. The light sensitive components on the liquid storage box are beamed and identified by the optical detection mechanisms arranged in the accommodating portion and corresponding to the beaming identification areas.

As a solution, the optical detection mechanism includes the light emitting part and light receiving part set on the two side walls of the accommodating portion opposite to each other. The positions of the light emitting part and light receiving part correspond to the position of the light blocking part by one-to-one.

After the liquid storage box is installed in the accommodating portion, the light blocking parts on the liquid storage box block the beams emitted from the light emitting parts to the beaming identification areas from passing through. The light receiving parts accordingly receive the beams emitted from different combinations.

Preferably, the additive dispensing apparatus also includes an identification unit. The type of additive in the liquid storage box is determined by the identification unit based on the beam information received by the light receiving part.

As a solution, the light sensitive component has the reflection surface, or the light sensitive component is identification labels with different colors arranged on the outer wall of the liquid storage box. The optical detection mechanism includes the light emitting part and the light receiving part arranged on the same side wall of the accommodating portion.

The positions of the light emitting part and the light receiving part correspond to the positions of the light sensitive component by one-to-one. The light receiving part receives the beams reflected by the light sensitive component arranged on the corresponding position. After the liquid storage box is installed in the accommodating portion, the light sensor component on the liquid storage box reflects the beams on the light receiving part at the corresponding position.

Preferably, the additive dispensing apparatus also includes the identification unit. The type of additive in the liquid storage box is determined by the identification unit based on the reflecting beam received by the light receiving part.

The other objective of the disclosure is to provide a method for identifying the type of additive in the above-mentioned additive dispensing apparatus. When the liquid storage box is inserted into the accommodating portion of the additive dispensing apparatus, the light emitting parts of the optical detection mechanisms start emitting the beams to the light sensitive components of the liquid storage box. The type of additive in the liquid storage box is determined according to the information of the reflected beams received the light receiving parts.

As a solution, after it is determined that the liquid storage box is installed into the accommodating portion, the optical detection mechanisms are controlled to start, and the light emitting parts of the optical detection mechanisms start emitting the beams.

The light blocking protrusions on the liquid storage box block the beams emitted by the light emitting parts on the corresponding position from passing through. The light receiving parts of the optical detection mechanisms receive the beams of different combinations. The type of additive in the liquid storage box is determined according to the position and/or quantity information of the beams received the light receiving parts.

As a solution, after the liquid storage box is installed into the accommodating portion, the optical detection mechanisms are controlled to start, and the light emitting parts of the optical detection mechanisms start emitting the beams.

The beams emitted by the light emitting parts are reflected by the light sensitive components, and the reflected beams get to the light receiving parts on the corresponding position. The type of additive in the liquid storage box is determined according to the position, quantity and/or frequency information of the reflected beams received the light receiving parts.

Comparing with the prior art, the present disclosure has the following advantages by the above solutions.

1. Through the arrangements of the light sensitive component arranged on the liquid storage box and the optical detection mechanism correspondingly arranged in the additive dispensing apparatus, the light emitting part of the optical detection mechanism emits the beams to the light sensitive component on the liquid storage box when it is determined that the liquid storage box is inserted into the accommodating portion of the additive dispensing apparatus. The type of additive in the liquid storage box is determined according to the beam information received by the light receiving part of the optical detection mechanism. The present disclosure can realize to automatically identify the type of additive in the liquid storage box by means of electrical detection and without contact, and it is achieved high identification efficiency and identification accuracy.

2. The light sensitive component on the liquid storage box in this disclosure is the light blocking protrusion on the liquid storage box. When the liquid storage box is installed in the accommodating portion, the light blocking protrusion of the liquid storage box blocks the beams emitted by the light emitting part corresponding to the light blocking protrusion from passing through, and the light receiving part of the optical detection mechanism accordingly receives the beams of different arrangements. Based on the information of position and/or quantity of the beams received by the light receiving part, the type of additive in the liquid storage box can be determined. The light blocking protrusion is as the light sensitive component, the structure is simple, and is easy to operate. Through different arrangements of the light blocking protrusions, the type of additive in the liquid storage box can be accurately identified. Thereby the type of the additive in the liquid storage box is automatically and accurately identified, which is the significant technological progress.

3. In the present disclosure, the identification labels with different colors arranged on the liquid storage box are as the light sensitive component, or the light sensitive component has the reflection surface. When the liquid storage box is installed in the accommodating portion, the beam emitted by the light emitting part is reflected by the light sensitive component, and the reflecting beams get to the light receiving part on the corresponding position. The type of additive in the liquid storage box can be determined based on the position, quantity, and/or frequency information of the reflecting beams received by the light receiving part. Using the information of the reflecting beams received by the light receiving part, the type of additive in the liquid storage box is determined. The method for determining the type of additive in the liquid storage box by means of the optical detection and identification is concise. The arrangements of the light sensitive component, the light emitting part and the light receiving part are more flexible.

The structure of the present disclosure is simple, and the method is concise and takes significant effects, so it is suitable to be widely used.

Specific embodiments of the present disclosure will be further described below in detail in combination with the accompanying drawings.

DETAILED DESCRIPTION OF THE DRAWINGS

The drawings as one part of the present disclosure are intended to provide a further understanding for the present disclosure. Schematic embodiments of the present disclosure and the descriptions thereof are intended to explain the present disclosure, rather than to constitute an improper limitation of the present disclosure. Obviously, the drawings described below are merely some embodiments. Under the precondition of not paying any inventive labor, those of ordinary skill in the art can further obtain other drawings according to these drawings.

Figure 1:
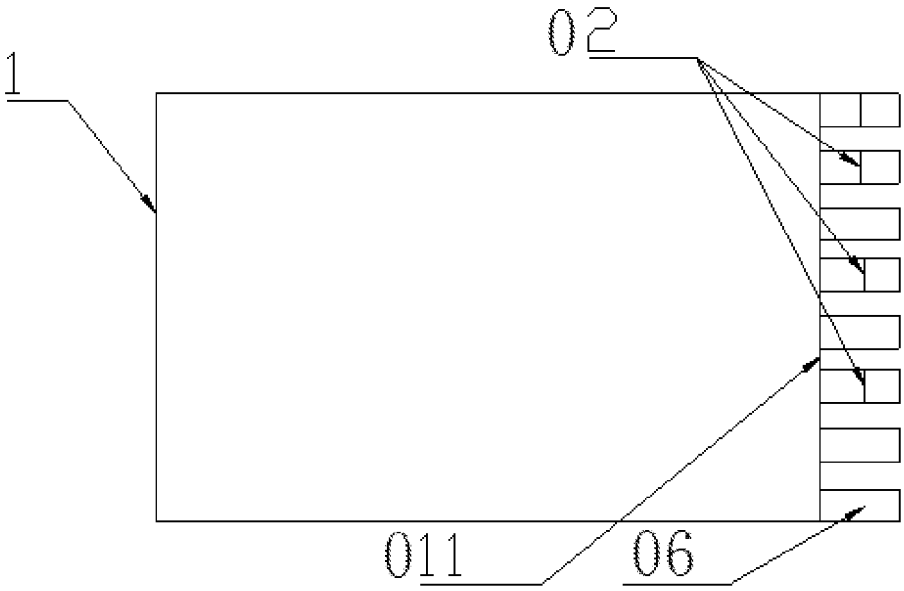
FIG. 1 is the side view of the liquid storage box according to the embodiment of the disclosure.

1. Liquid storage box; 011. Insertion end; 11. Front wall; 2. Light sensitivity component; 3. Accommodating portion; 4. Optical detection mechanism; 41. Light emitting part; 42. Light receiving part; 02. Marking conductive component; 04. Identification conductive component; 05. Enhancing voltage unit; 06. Protrusion; 07. Groove It should be noted that these drawings and descriptions are not intended to limit the scope of the present disclosure in any way, but rather to illustrate the concept of the present disclosure by reference to specific embodiments for those skilled in the art.

EMBODIMENTS

In order to make the objects, technical solutions and advantages of the embodiments of the present disclosure clearer, a clear and complete description is given below on the technical solutions in the embodiments in combination with accompanying drawings in the embodiments of the present disclosure, and the following embodiments are used for illustrating the present disclosure, rather than limiting the scope of the present disclosure.

In the description of the present disclosure, it should be noted that, the orientation or positional relationship indicated by such terms as "up", "down", "front", "rear", "left", "right", "vertical", "inner" and "outer" is the orientation or positional relationship based on the accompanying drawings. Such terms are merely for the convenience of description of the present disclosure and simplified description, rather than indicating or implying that the apparatus or element referred to must be located in a certain orientation or must be constructed or operated in a certain orientation, therefore, the terms cannot be understood as a limitation to the present disclosure.

In the description of the present disclosure, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection or can be indirect connection through an intermediate. For those skilled in the art, specific meanings of the above terms in the present disclosure can be understood according to specific conditions.

The following embodiments describes in detailed the disclosure.

Embodiment 1

As shown in FIGS. 1 to 7, the disclosure provides a liquid storage box 1, an additive dispensing apparatus and a method for identifying the type of additive. The liquid storage box provided by the present disclosure is provided with a marking conductive component 02. Any one element or a combination of elements selected from a group consisting of the quantity, position, shape, and resistance of the marking conductive component 02 set on the liquid storage box 1 corresponds to the type of additive in the liquid storage box 1.

In the present disclosure, there are types of the storage boxes for holding different types of additives. Any one element or a combination of elements selected from a group consisting of the quantity, position, shape, and resistance of the marking conductive component 02 in one liquid storage box 1 is different from that of the liquid storage boxes, so that the information of the marking conductive component 02 set on the liquid storage box 1 can be used to represent the type of additive stored in the liquid storage box 1.

In the embodiment of the present disclosure, the types of additives include detergent, fragrance enhancer, softener, and disinfectant. The additives of the different types can be dispensed separately or in combination of thereof, so the laundry is treated by the additives of the different types when different programs are executed by the laundry treatment device. At the same time, in the embodiment of the present disclosure, detergents of different concentrations can also be stored in the liquid storage boxes 1 installed on the additive dispensing apparatus, such as super-concentrated, concentrated, normal, low foam, etc. The detergent of the corresponding type is dispensed to wash different laundry when the different washing program is executed by the laundry treatment device, thereby achieving the purpose of improving the washing effect of the laundry treatment device.

The present disclosure also provides an additive dispensing apparatus, which has at least one accommodating portion 3 in which the liquid storage box 1 is installed. Identification conductive parts 04 are arranged in the accommodating portion 3, and the identification conductive parts 04 cover the projections of the marking conductive parts 02 of the liquid storage boxes 1 on the accommodating portion 3. Each of the marking conductive components 02 on the liquid storage box 1 corresponds to and is spaced apart from one of the identification conductive components 04 provided in the accommodating portion 3, to form a capacitance that corresponds to the type of additive stored in the liquid storage box 1.

In the present disclosure, the additive dispensing apparatus acquires the information of the capacitance between the marking conductive component 02 on the liquid storage box 1 inserted in the accommodating portion 3 and the corresponding identification conductive component 04, so as to obtain the information of the type of additive in the liquid storage box 1 indicated by the information of the marking conductive component 02. Thereby, the type of additive in the liquid storage box 1 can be accurately identified.

In the present disclosure, through the marking conductive component 02 on the liquid storage box 1 and the identification conductive component 04 correspondingly provided on the additive dispensing apparatus, there is a capacitance between the marking conductive component 02 on the liquid storage box 1 and the identification conductive component 04 set on the projections thereof when it is determined that the liquid storage box 1 is inserted into the accommodating portion 3 of the additive dispensing apparatus. The type of the additive in the liquid storage box 1 is determined according to the detection information of whether the identification conductive component 04 forms a capacitance, and the amount of the capacitance. The present disclosure can realize to automatically identify the type of additive in the liquid storage box 1 by means of electrical detection and without contact, and it is achieved high identification efficiency and identification accuracy.

As shown in FIG. 1, FIG. 3 to FIG. 6, the present embodiment provides a liquid storage box 1. The liquid storage box 1 has a closed chamber for storing additive. At least one marking conductive component 02 is arranged on the liquid storage box 1.

Any one element or a combination of elements selected from a group consisting of the quantity, position, shape, and resistance etc. of the marking conductive component 02 set on the liquid storage box 1 corresponds to the type of additive in the liquid storage box 1. In this embodiment, through the marking conductive component 02 provided on the liquid storage box 1, the type of the additive in the liquid storage box 1 is identified by utilizing any or any combination of identification information such as the quantity, position, light transmittance of the light sensitive component. The type of the additive in the liquid storage box 1 is accurately identified by means of electrical identification and detection. The apparatus has a simple structure, is easy to operate, and has high identification efficiency and identification accuracy.

As shown in FIG. 1, FIG. 3 to FIG. 6, in this embodiment, the marking conductive component 02 is a conductive metal sheet arranged on the liquid storage box 1. There is difference in the quantity, position, shape, thickness, and/or material etc. of the marking conductive metal sheet on the liquid storage box 1 for storing different types of additives.

Correspondingly, it is different in the amount of the capacitance between the marking conductive metal sheets on the liquid storage box 1 storing different type of additive and the identification conductive metal sheet arranged on the projections of the marking conductive metal sheets on the dispensing apparatus. The amount of capacitance formed by the identification conductive metal sheets set at different positions can be directly obtained by the means of the electrical detection. Thereby, the type of additive in the liquid storage box 1 can be directly and accurately obtained.

Figure 5:
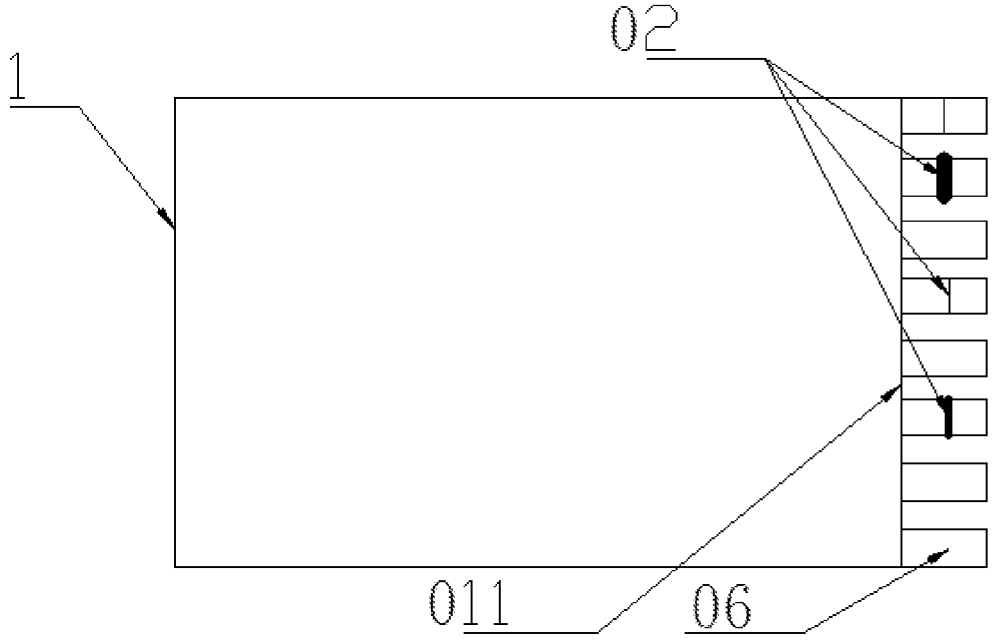
FIG. 5 is the side view of the liquid storage box according to another embodiment of the disclosure.

For example, as shown in FIG. 5, the type of additive in the liquid storage box 1 can be identified by the thickness of the identification conductive metal sheet. In one solution, the identification conductive metal sheet is arranged inside the box body of the liquid storage box 1. The box wall of the liquid storage box 1 has a set marking area, and the marking conductive metal sheet can be arranged in the marking area of the liquid storage box 1. The thickness of the marking conductive metal sheet on the liquid storage box 1 of different type is different. The type of the additive in the liquid storage box 1 can be accurately obtained by detecting the capacitance between the marking conductive metal sheet and the identification conductive metal sheet by the electrical detection apparatus.

Figure 4:
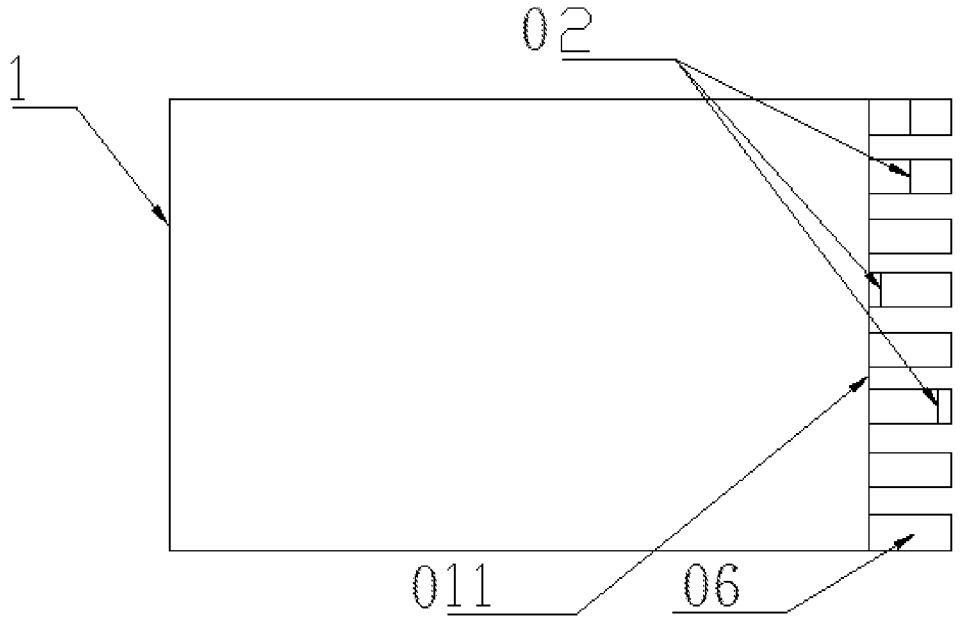
FIG. 4 is the side view of the liquid storage box according to another embodiment of the disclosure.

Alternatively, as shown in FIG. 4, the type of additive stored in the liquid storage box 1 is identified by the relative position of the marking conductive metal sheet on the box wall of the liquid storage box 1. In another solution, there is a set identification area on the box wall of the liquid storage box 1, and the marking conductive metal sheet is set in the set identification area of the liquid storage box 1. The marking conductive metal sheet on the liquid storage box 1 of different type is arranged on different sections of the box wall of the liquid storage box 1. The relative distance between the marking conductive metal sheet and the identification conductive metal sheet can be obtained by identifying the capacitance of the identification conductive metal sheet at the position corresponding to the interval of the marking areas, and then the type of additive stored in the liquid storage box is accurately determined. For example, the marking conductive metal sheet can be exposed at the outer wall of the liquid storage box 1; or, the marking conductive metal sheet can be embedded in the inside of the box wall constituting the closed chamber of the liquid storage box 1; or, the identification conductive metal sheet may be provided on the inner surface of the box wall constituting the closed chamber of the liquid storage box 1, or the like.

Figure 6:
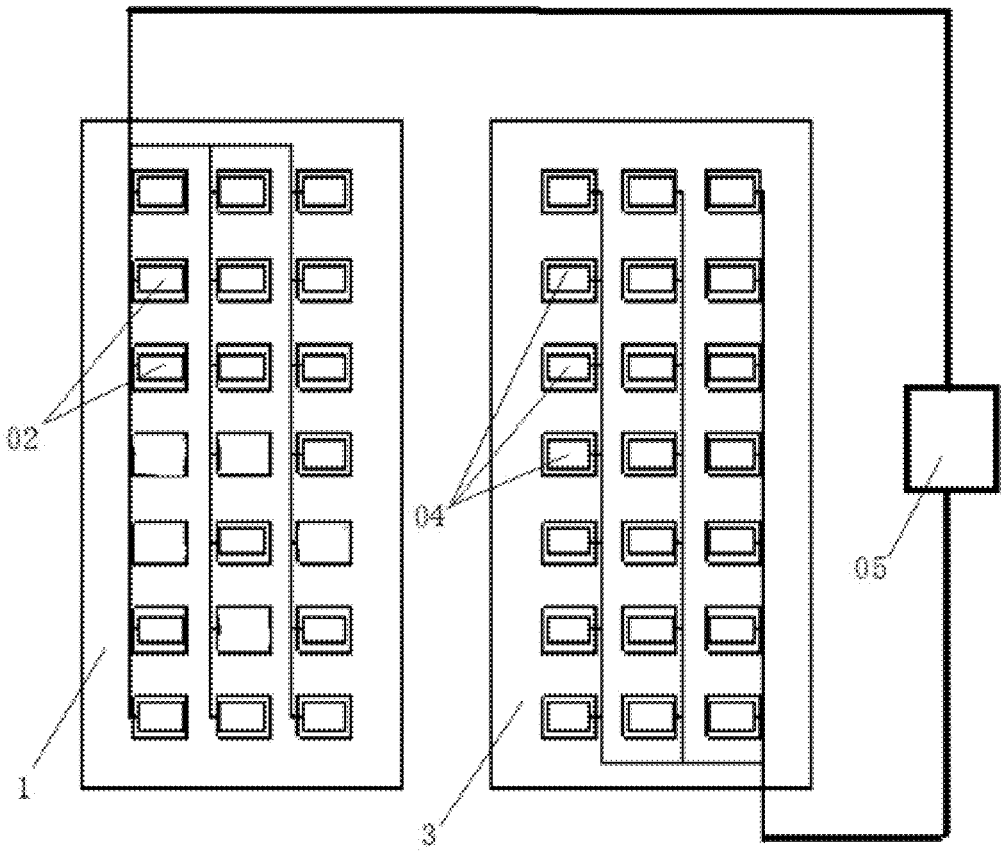
FIG. 6 is the connection schematic diagram of the identification principle of the liquid storage box and the dispensing apparatus according to the embodiment of the disclosure.

Preferably, as shown in FIG. 1 and FIG. 6, in this embodiment, the type of additive in the liquid storage box 1 is indicated correspondingly according to the position and quantity of the marking conductive metal sheet on the liquid storage box 1. Preferably, the marking conductive metal sheets on the liquid storage box 1 have multiple arrangements, and the different arrangements of the marking conductive metal sheets in different correspond to different types of additives in the liquid storage boxes 1.

In one solution, the box wall of the liquid storage box 1 has a plurality of set marking areas. The marking conductive metal sheet is on any one marking area or a combination of marking areas on the box wall of the liquid storage box 1. By identifying the capacitance of the identification conductive metal sheet at the interval position corresponding to the marking areas, the position and quantity of the marking conductive metal sheet can be acquired, and then the type of the additive in the liquid storage box 1 can be accurately obtained.

Preferably, as shown in FIG. 1, FIG. 3 to FIG. 5, the liquid storage box 1 has an insertion end 011 for be connected with the dispensing apparatus. At least one protrusion 06 is arranged on the insertion end 011 of the liquid storage box 1, and is extended in a direction of inserting the liquid storage box 1. The marking conductive metal sheet is arranged on one protrusion 06 or more protrusions 06. The marking conductive metal sheet can be exposed at the end of the protrusion 06, and/or buried inside the protrusion 06. By arranging the marking conductive metal sheet on the protrusion 06, the protrusion 06 can identify the type of additive in the liquid storage box 1, and can also play a role in connecting and positioning the liquid storage box 1 with the dispensing apparatus.

The insertion end 011 of the liquid storage box 1 has a plurality of setting positions in multiple rows and columns, and the marking conductive metal sheet is arranged on one setting position or the setting positions. In order to ensure to detect the capacitance between the marking conductive metal sheet on the protrusion 06 of the insertion end 011 and the identification conductive metal sheet, it is generally required that the marking conductive metal sheet is perpendicular to the insertion direction of the liquid storage box 1.

As shown in FIG. 6, in this embodiment, in order to form capacitance between the marking conductive component 02 and the identification conductive component 04, the marking conductive component 02 is electrically connected with the identification conductive component 04, and an enhancing voltage unit 05 is set on the electrical connection path. It is realized that the marking conductive component 02 and the identification conductive component 04 constitutes the capacitive plates, and the amount of the capacitance between them is accurately detected. The above effects can be achieved by the following arrangements in this embodiment.

All of the marking conductive components 02 are connected to the same first connection terminal via a connection circuit arranged in parallel. The first connection terminal is used for connecting with the second connection terminal in the corresponding accommodating portion 3 of the dispensing apparatus. In the present disclosure, after the liquid storage box 1 is correspondingly inserted into the accommodating portion 3 of the dispensing apparatus, the first connection terminal is correspondingly connected with the second connection terminal, and then the capacitance is formed between all the marking conductive components 02 and the identification conductive component 04. The type of additive in the liquid storage box 1 can be accurately obtained by detecting and identifying the above mentioned capacitance through the electrical detection unit.

As shown in FIGS. 1 to 6, this embodiment provides an additive dispensing apparatus on the basis of the above disclosure. The additive dispensing apparatus has at least one accommodating portion 3 for placing the liquid storage box 1 described in this embodiment. A plurality of identification conductive components 04 are arranged in the accommodating portion 3, and all of the identification conductive components 04 cover the projections of the marking conductive components 02 of different liquid storage boxes 1 on the accommodating portion 3. The marking conductive component 02 on the liquid storage box 1 is spaced apart from the identification conductive component 04 in the accommodating portion 3, so as to form the capacitance for correspondingly indicating the type of additive in the liquid storage box 1.

In this embodiment, through the arrangement of the marking conductive component 02 on the liquid storage box 1 and the identification conductive component 04 correspondingly provided on the additive dispensing apparatus, the capacitance for indicating the type of additive in the liquid storage box 1 can be formed between the marking conductive metal sheet on the liquid storage box 1 and the identification conductive metal sheet at the corresponding position in the accommodating portion 3 of the dispensing apparatus, when the liquid storage box 1 is installed in the accommodating portion 3. The type of additive in the liquid storage box 1 can be determined according to the capacitance information detected. The above-mentioned structure is simple, and easy to realize. On the basis of combines of quantity, position, thickness and shape of the marking conductive metal sheet on the liquid storage box 1, it is realized that the type of additive in the liquid storage box 1 is accurately identified. Thereby the type of the additive in the liquid storage box 1 is automatically and accurately identified, which is the significant technological progress.

In this embodiment, the additive dispensing apparatus can be any existing structure to dispense the additive in the liquid storage box 1 placed in the accommodating portion 3. For example: the additive dispensing apparatus is provided with at least one liquid storage box 1 for holding additive. Via the dispensing unit, each of the liquid storage boxes 1 is connected with the waterway, for feeding water into the drum, of the washing machine, so that each additive dispensing apparatus is controlled to dispense at least one additive into the drum accordingly.

In this embodiment, the dispensing unit can be any existing apparatus that can realize to dispense additive, such as a suction pump that generates suction force to pump out additive during operation, and Venturi tube that generates a negative pressure to pump out additive by water flow, and the like.

In one embodiment, the identification conductive component 04 is an identification conductive metal sheet provided in the accommodating portion 3. The identification conductive metal sheet is exposed on the inner wall of the accommodating portion 3, or embedded in the interior of the accommodating portion 3. The marking conductive metal sheets on the liquid storage box 1 are arranged parallel to and spaced apart from the identification conductive metal sheets provided at the corresponding projections, of the marking conductive metal sheets, on the accommodating portion 3.

Preferably, in order to ensure that a capacitance can be formed between the marking conductive metal sheet and the corresponding identification conductive metal sheet, both of them is spaced apart with each other with a non-conductive material, and the following arrangement can be made. There is an interval space between the marking conductive metal sheet and the corresponding identification conductive metal sheet. In the interval space, there is a box wall of the liquid storage box 1 and/or a cavity wall of the accommodating portion 3 made of non-conductive material. The box wall of the liquid storage box 1 and/or the cavity wall of the accommodating portion 3 are/is as the non-conductive material between the two capacitor plates composed of the marking conductive metal sheet and the corresponding identification conductive metal sheet. It is ensured that the amount of capacitance changes accordingly, and then the type of liquid storage box 1 can be accurately identified.

In this embodiment, the projection area of the marking conductive metal sheet of the liquid storage box 1 on the surface and/or inside of the accommodating portion 3 along the vertical direction is as the projection position, of the marking conductive component 02 of the liquid storage box 1, on the accommodating portion 3. For example: when the marking conductive metal sheet is arranged on the insertion end 011 of the liquid storage box 1, the projection area of the marking conductive metal sheet on the bottom of groove and the internal of the groove in the insertion direction of the liquid storage box 1 is the projection position of the marking conductive component 02 of the liquid storage box 1 on accommodating portion 3. Or, when the marking conductive metal sheet is arranged on the side wall of the liquid storage box 1 and is parallel to the insertion direction, the projection area of the marking conductive metal sheet on the side wall of groove and the internal of the groove in the direction vertical to the insertion direction of the liquid storage box 1 is the projection position of the marking conductive component 02 of the liquid storage box 1 on accommodating portion 3.

Figure 2:
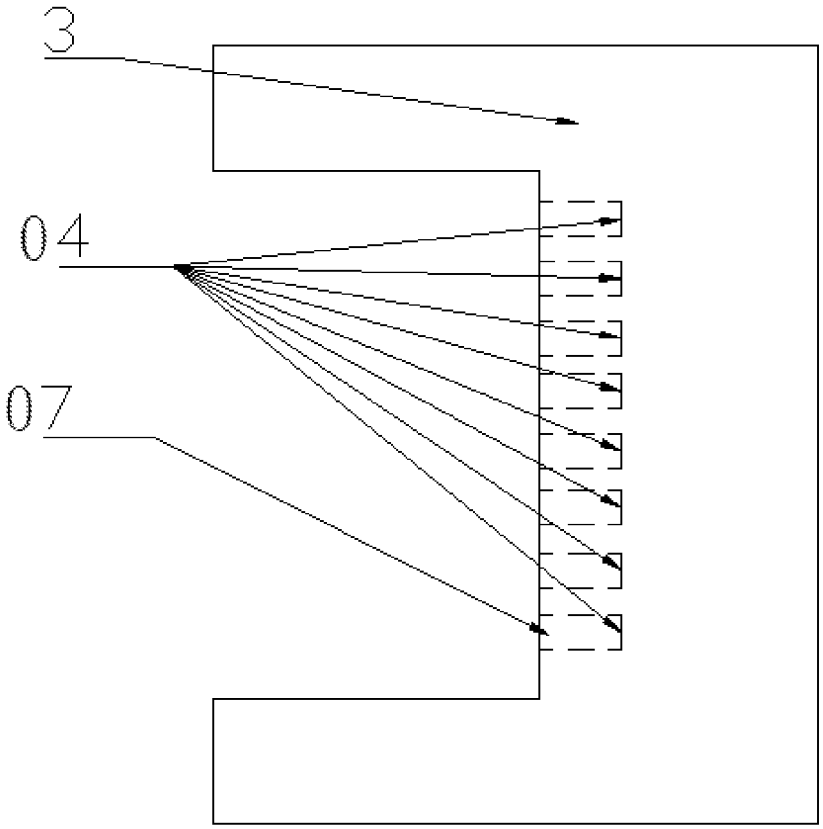
FIG. 2 is the cross-section view of the side of the accommodating portion of the additive dispensing apparatus according to the embodiment of the disclosure.
Figure 3:
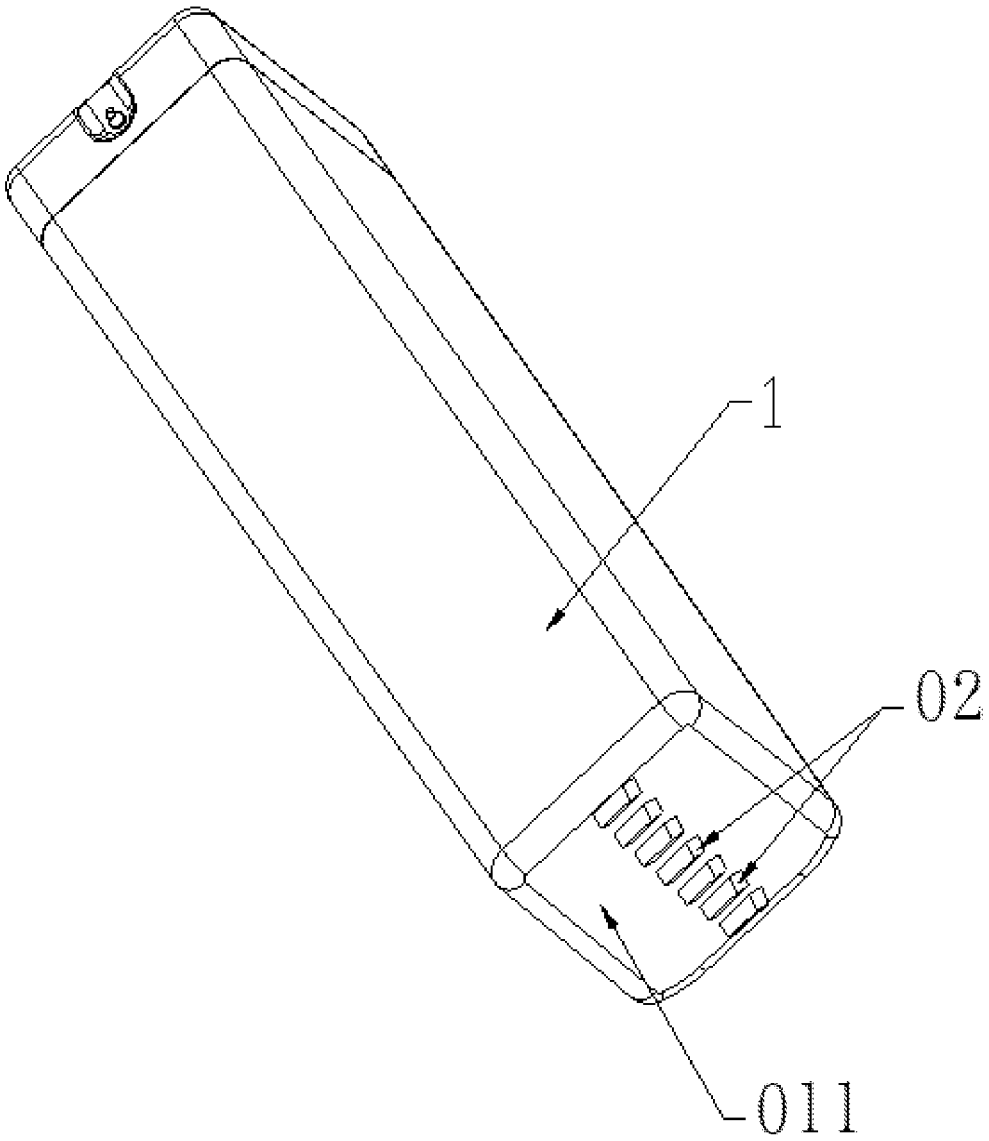
FIG. 3 is the structural diagram of the liquid storage box according to the embodiment of the disclosure.

Preferably, as shown in FIG. 2, the accommodating portion 3 has a bottom wall being in contact with the insertion end 011 of the liquid storage box 1, and the bottom wall is provided with grooves 07 for allowing the protrusions 06 of the insertion ends 011 of different liquid storage boxes 1 to be in inserted. The bottom of each of the grooves 07 is provided with identification conductive metal sheet perpendicular to the insertion direction of the liquid storage box 1. The identification conductive metal sheet at the bottom of each of the grooves 07 is used for identifying and detecting the marking conductive metal sheet set on the protrusion 06 of the insertion end 011 of the liquid storage box 1, and then the type of additive in the liquid storage box 1 can be accurately acquired.

Further, as shown in FIG. 1 to FIG. 6, a plurality of the protrusions 06 are extended along the insertion direction of the insertion end 011 of the liquid storage box 1, and are arranged in rows and columns on the surface of the insertion end 011. A plurality of grooves 07 are also arranged on the bottom wall of the accommodating portion 3 of the dispensing apparatus. The protrusions 06 of the liquid storage box 1 correspond to the grooves 07 on the bottom wall of the accommodating portion 3 one-to-one along the insertion direction of the liquid storage box 1.

Further, the arrangement and combination of the protrusions 06 on the liquid storage box 1 for storing different types of additives are different, and each of the protrusions 06 is respectively provided with the marking conductive component 02. After the liquid storage box 1 is installed in the accommodating portion 3, a capacitance is formed between the marking conductive component 02 set on the protrusion 06 and the identification conductive component 04 set at the projection on the accommodating portion 3. According to the detection information of whether the marking conductive component 02 forms a capacitance in the accommodating portion 3, the type of liquid storage box 1 can be identified.

In this embodiment, all the identification conductive components 04 provided on the accommodating portion 3 of the dispensing apparatus are respectively connected to the same second connection terminal via a connecting circuit arranged in parallel. The second connection terminal is connected with the first connection terminal arranged on the liquid storage box 1 being inserted in the accommodating portion 3 of the dispensing apparatus. A capacitance is formed between the marking conductive component 02 on the liquid storage box 1 and the identification conductive components 04 on the interval position in the accommodating portion 3 of the dispensing apparatus.

At the same time, as shown in FIG. 6, in order to form a capacitance, an enhancing voltage unit 5 is arranged on the connecting circuit between the identification conductive component 04 and the marking conductive component 02, for applying voltage on the capacitance formed by the identification conductive component 04 and the marking conductive component 02. The enhancing voltage unit 05 can be a storage battery or the like.

In the present embodiment, each of the identification conductive components 04 is connected to a detection unit provided on the dispensing apparatus respectively. The detection unit is used for detecting whether the identification conductive component 04 constitutes a capacitance, and detecting the amount of the capacitance. It is directly acquired whether the marking conductive component 02 (not shown in the drawings) is provided at the position of the liquid storage box 1 corresponding to the identification conductive component 04.

In addition, in this embodiment, an identification unit is also provided on the dispensing apparatus. The identification unit is connected to each of the detection units, and is used for receiving the information issued from each of the detection units about whether the identification conductive component 04 constitutes a capacitance and the amount of the capacitance. The identification unit determines the type of additive in the liquid storage box 1 based on whether the identification conductive component 04 constitutes a capacitance determined by each detection unit, and the amount of the capacitance. Therefore, the type of the additive in the liquid storage box 1 can be accurately detected in the dispensing apparatus (not shown in the drawings).

Figure 7:
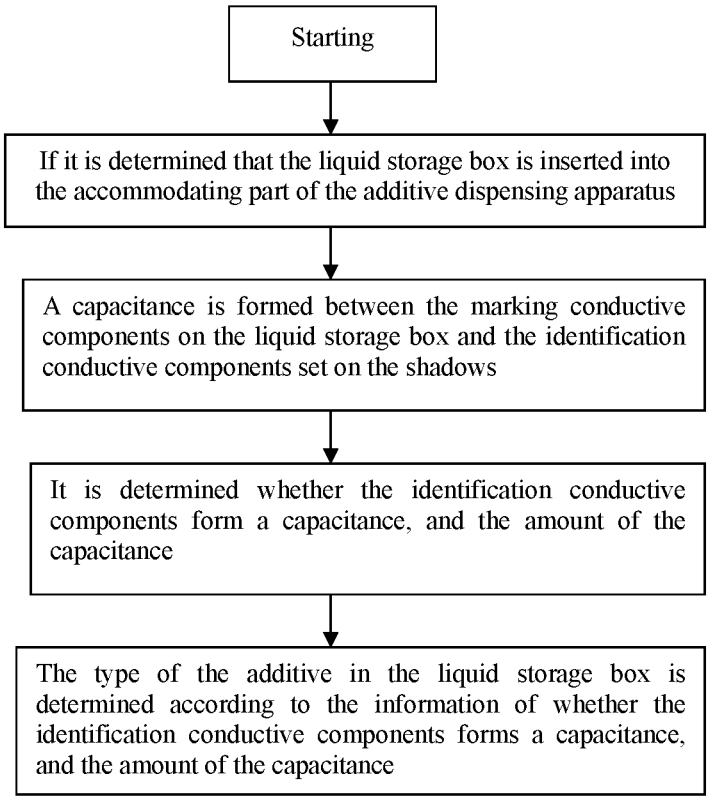
FIG. 7 is the principle schematic diagram of the method for identifying the type of additive according to the embodiment of the disclosure.

As shown in FIG. 7, this embodiment also describes a method for identifying the type of additive in the above-mentioned additive dispensing apparatus, which includes the following:

- inserting the liquid storage box 1 into the accommodating portion 3 of the additive dispensing module;
- forming a capacitance between the marking conductive components 02 on the liquid storage box 1 and the identification conductive component 04 at the projection on the accommodating portion 3;
- obtaining information about whether the identification conductive component 04 in the accommodating portion 3 forms a capacitance, and the amount the capacitance; and
- determining the type of additive in the liquid storage box 1 based on whether the identification conductive component 04 in the accommodating portion 3 forms a capacitance and the amount of the capacitance.

In the present disclosure, the type of additive in the liquid storage box 1 can be accurately determined by using the capacitance information formed between the liquid storage box 1 and the accommodating portion 3 of the dispensing apparatus. A method for identifying the type of additive in the liquid storage box 1 by means of the electrical detection is provided. The method is simple, and makes the arrangement of the conductive component more flexible.

Embodiment 2

As shown in FIGS. 8 to 16, the embodiment of the present disclosure also provides a liquid storage box, an additive dispensing apparatus, and a method for identifying the type of additives. Alight sensitive component 2 is arranged on the liquid storage box 1.

Any one element or any combination of elements selected from a group consisting of the quantity, position, and light transmission of the light sensor part on the liquid storage box 1 corresponds to the type of additive in the liquid storage box 1.

The type of additives in the liquid storage box 1 is identified by the light sensitive component 2. An optical detection mechanism 4 is used for identifying the light sensitive component 2, further the type of additive in the liquid storage box 1 is determined. In the disclosure, the type of additive in the liquid storage box 1 can be automatically identified by means of optical detection, without contact, which has high identification efficiency and identification accuracy.

The light sensitive component 2 in the embodiment of the present disclosure can be selected from a variety of light sensor structures. For example, the light sensitive component 2 can be a light blocking structure with different light transmittances, and the type of additive in the storage box 1 is identified by the different light transmittance of the light blocking structure. The type of additive in the storage box 1 is determined according to the intensity of the light beams which pass through light blocking structure and are received by the light receiving part 42 of the optical detection mechanism 4.

Alternatively, the light sensitive component 2 is the light blocking structure with a light transmittance of zero. The light blocking structure can completely block the light beams emitted by the light emitting part 41 of the optical detection mechanism 4 to pass through. The liquid storage boxes 1 containing different types of additives are provided with different positions and quantities of the light blocking structure. The type of additive in the liquid storage box 1 is determined by determining the combination of the light beams received by the light receiving part 42 the optical detection mechanism 4.

Alternatively, the light sensitive component 2 is a reflector with different light reflections. The type of additive in the liquid storage box 1 is determined by the information of the light beam which is reflected by the reflector and received by the light receiving part 42 the optical detection mechanism 4.

It should be noted that the light sensitive component 2 in the embodiment of the present disclosure can be any one of the above, but it is not limited to that.

In the embodiment of the present disclosure, there can be types of the liquid storage boxes. The liquid storage boxes 1 are used for holding different types of additives. The liquid storage boxes 1 for holding different types of additives are provided with different features which are any one or a combination of elements selected from a group consisting of the quantity, position, and light transmittances of the light sensitive component 2. In the embodiment of the present disclosure, the types of additives include detergent, fragrance enhancer, softener, disinfectant etc.. The additives of the different types can be dispensed separately or in combination of thereof, so the laundry is treated by the additives of the different types when different programs are executed by the laundry treatment device.

At the same time, in the embodiment of the present disclosure, the liquid storage boxes 1 installed in the additive dispensing apparatus can also store detergents with different concentrations, such as super-concentrated, concentrated, normal, low foam, etc. The detergent of the corresponding type is dispensed to wash different laundry when the different washing program is executed by the laundry treatment device, thereby achieving the purpose of improving the washing effect of the laundry treatment device.

As shown in FIG. 8, FIG. 9, and FIGS. 11 to 13, this embodiment provides a liquid storage box 1. The liquid storage box 1 has a closed chamber for storing additive. At least one light sensitive component 2 is arranged on the liquid storage box 1. Any one element or a combination of elements selected from a group consisting of the quantity, position, and the light transmittance etc. of the light sensitive component 2 set on the liquid storage box 1 corresponds to the type of additive in the liquid storage box 1. In this embodiment, through the light sensitive component 2 provided on the liquid storage box 1, the type of the additive in the liquid storage box 1 is identified by utilizing any or any combination of identification information such as the quantity, position, light transmittance of the light sensitive component 2. The type of the additive in the liquid storage box 1 is determined by means of optical identification and detection. The apparatus has a simple structure, is easy to operate, and has high identification efficiency and identification accuracy.

In one embodiment, the light sensitive component 2 is one or more light blocking parts on the liquid storage box 1. The liquid storage boxes with different types of additives are provided with different quantity, position, thickness, material and/or color of the light blocking part.

In the above solutions, there are different light transmittances of the light blocking parts on the liquid storage boxes with different types of additives by setting different thickness, material and/or color of the light blocking parts on the liquid storage boxes with different types of additives. The type of the additive in the liquid storage box 1 is determined according the light transmittance of the light blocking part detected by the optical detection mechanism 4.

For example, the type of additive stored in the liquid storage box 1 can be identified by the thickness of the light blocking part. In one solution, the light blocking part is as a part of the box body of the liquid storage box 1. There is a set marking area on the box body of the liquid storage box 1, and the wall of the box body of the liquid storage box 1 in the set marking area is set as the light blocking part with different thickness, materials, and/or color. The light transmittance of the wall of the liquid storage box in the set marking area is detected by the optical detection mechanism 4, and then the type of additive in the liquid storage box 1 is determined. The light blocking part can be part of the box body of the liquid storage box 1. Of course, the light blocking part can also be the light blocking plate or the light blocking protrusion fixed to the liquid storage box 1.

Preferably, in this embodiment, there are a variety of combinations according to the position and quantity of the light blocking parts on the liquid storage box 1. The combinations of the light blocking parts correspond to different types of additives in the liquid storage boxes 1.

In one solution, the wall of the liquid storage box 1 has multiple of the set marking areas. The wall in any one or the combination of the set marking areas the box walls is thicker to form the light blocking part. The position and quantity of the light blocking part are determined by the light transmittances in all the marking areas, and then the type of additive in the liquid storage box 1 is determined.

Alternatively, in another solution, the light blocking part is a light blocking protrusion which is protruded outward from the outer wall of the liquid storage box 1, or is protruded inward from the inner wall of the liquid storage box 1. Multiple of the light blocking protrusions are arranged linearly on the top wall or the side wall of the liquid storage box 1. The liquid storage boxes with different types of additives are provided with the different quantity and/or position of the light blocking protrusions.

Figure 8:
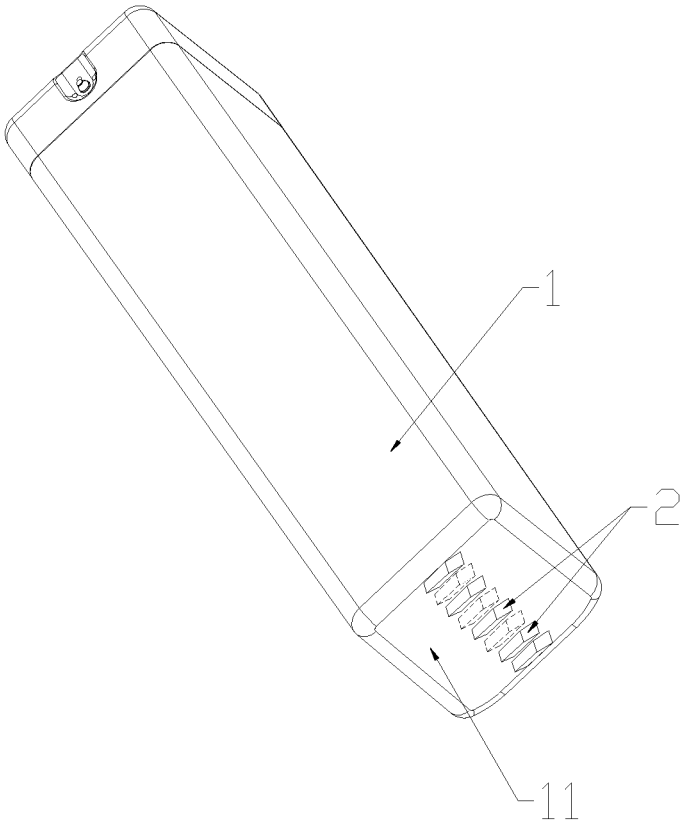
FIG. 8 is the structural diagram of the liquid storage box according to another embodiment of the disclosure.
Figure 9:
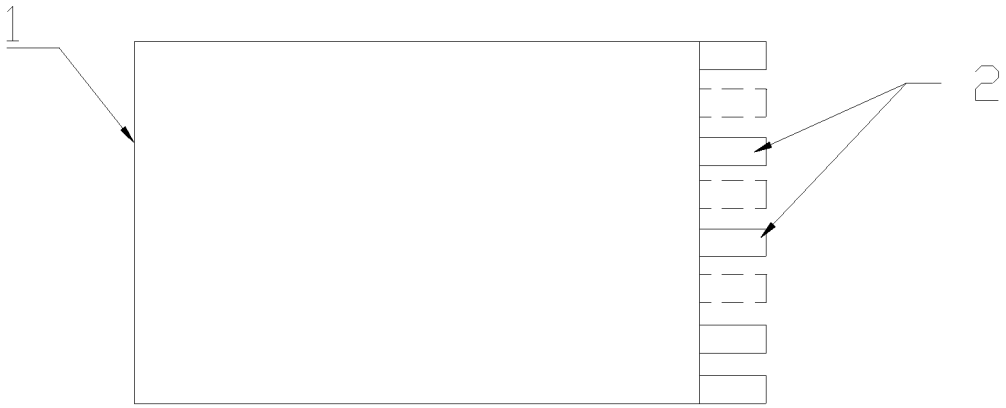
FIG. 9 is the side view of the liquid storage box according to the another embodiment of the disclosure.
Figure 10:
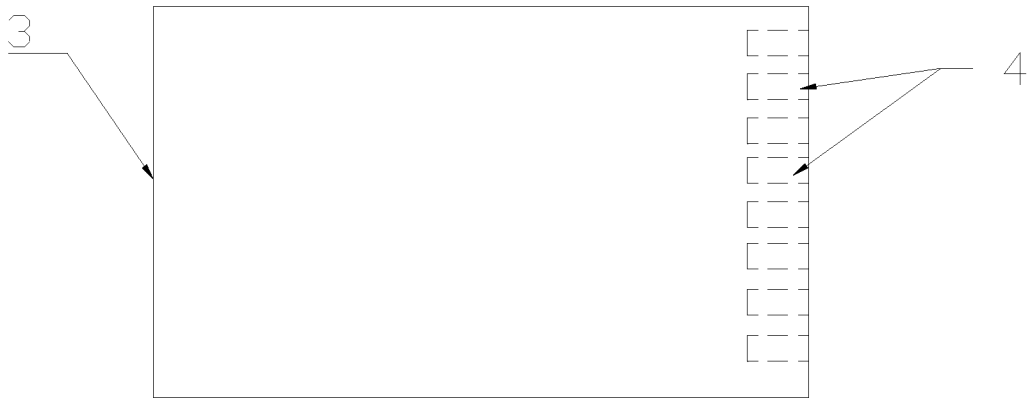
FIG. 10 is the side view of the accommodating portion of the additive dispensing apparatus according to another embodiment of the disclosure.

Preferably, as shown in FIG. 8 and FIG. 9, in the inserting direction of the liquid storage box 1, the light blocking part is set on the front wall 11 of the liquid storage box 1, and is multiple of the light blocking protrusions being protruded outward from the front wall 11 of the liquid storage box 1. Grooves matched with the light blocking protrusions are arranged in the accommodating portion 3 of the additive dispensing apparatus. On the one hand, the light blocking protrusions can play the role of identifying the type of additive in the liquid storage box 1; and on the other hand, it can also be used for positioning.

In another embodiment, the light sensitive component 2 has the reflection surface. Any one element or a combination of elements selected from a group consisting of the quantity, position, and reflectivity of the light sensitive component 2 set on the liquid storage box 1 corresponds to the type of additive in the liquid storage box 1. In one solution, the reflectivity of the light sensitive components 2 is different for the liquid storage boxes 1 with different types of additives. The different reflectivity of the light sensitive component 2 indicates correspondingly the liquid storage box 1 with different type of additive. For example, reflective coatings or reflector films with different reflectivity are respectively set on the light blocking protrusions.

Alternatively, in another embodiment, the light sensitive component 2 is identification labels with different colors arranged on the outer wall of the liquid storage box 1. The reflectivity of the identification labels with different colors is different. The color of the identification label indicates correspondingly the type of additive in liquid storage box 1.

Alternatively, in another embodiment, the light sensitive component 2 is characters arranged in the set marking area of the liquid storage boxes 1, for indicating the type of additive. The optical detection mechanism 4 is arranged in the additive dispensing apparatus to identify the characters. The type of additive in the liquid storage box 1 is determined by utilizing the optical detection mechanism 4 to identify the characters.

As shown in FIGS. 8 to 13, this embodiment provides an additive dispensing apparatus on the basis of the foregoing. At least one accommodating portion 3 for installing the liquid storage box 1 described in embodiment 1 is formed in the additive dispensing apparatus. As shown in FIG. 9, there are multiple of the optical detection mechanisms 4 in the accommodating portion 3, and the optical detection mechanisms 4 cover the beaming identification areas corresponding to the light sensitive component 2 on different liquid storage boxes 1. The light sensitive component 2 on the liquid storage box 1 is beamed and identified by the optical detection mechanism 4 arranged in the accommodating portion 3 and corresponding to the beaming identification areas.

Figure 11:
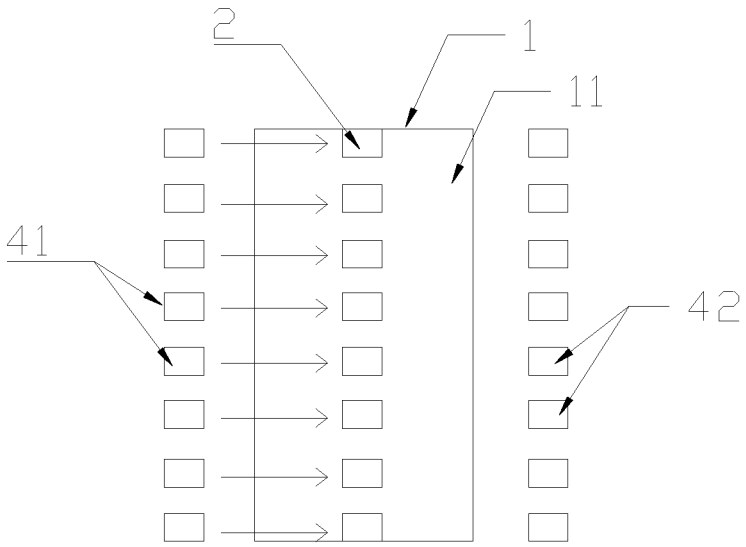
FIG. 11 is the structural principle diagram of identifying the first type of additive in the liquid storage box according to another embodiment of the disclosure.
Figure 12:
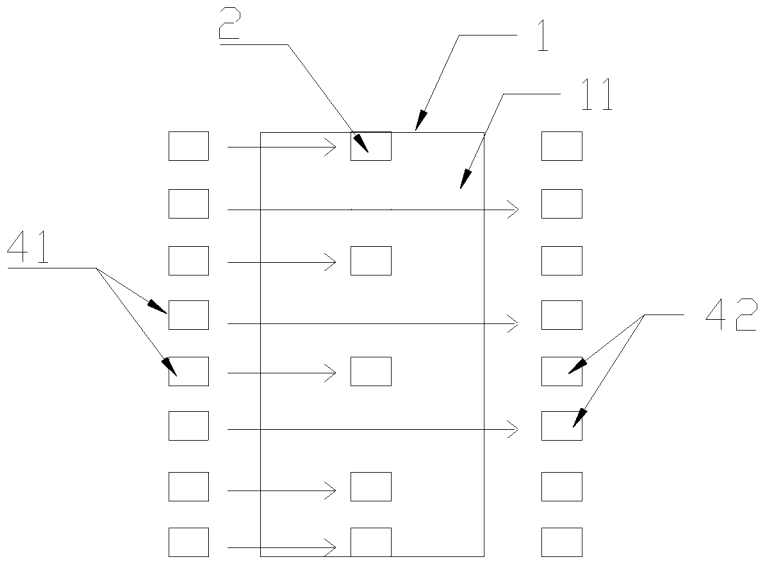
FIG. 12 is the structural principle diagram of identifying the second type of additive in the liquid storage box according to another embodiment of the disclosure.
Figure 13:
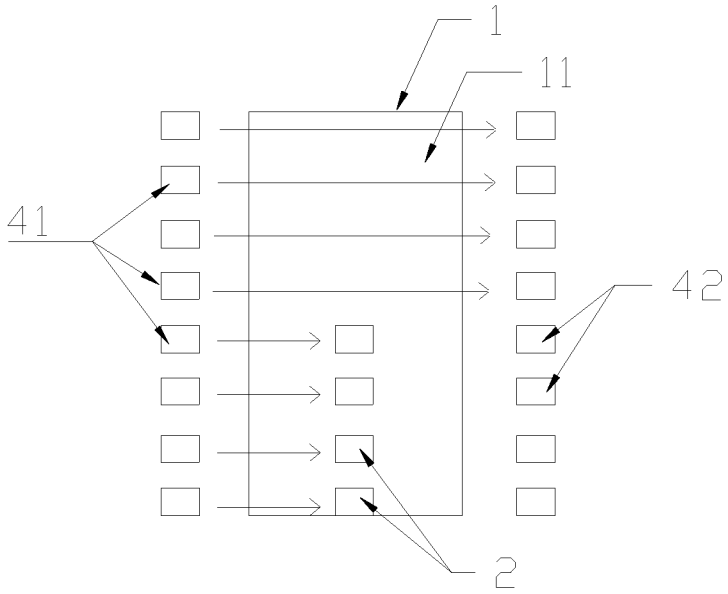
FIG. 13 is the structural principle diagram of identifying the third type of additive in the liquid storage box according to another embodiment of the disclosure.
Figure 14:
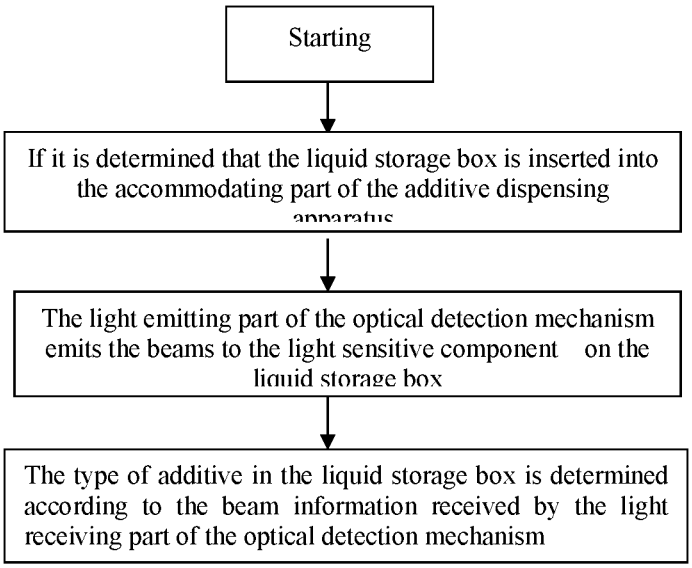
FIG. 14 is the flow diagram of the method for identifying the type of additive according to another embodiment of the disclosure.

In the above solution, as shown in FIGS. 11 to 13, the beaming identification areas are the positions where the light sensitive components 2 are arranged in the liquid storage box 1. When the liquid storage box 1 is placed in the accommodating portion 3, the optical detection mechanisms 4 emit respectively the beams to the beaming identification areas. If there is no the light sensitive component 2 on the beaming identification area, the beams emitted from the optical detection mechanism 4 directly pass through the beaming identification area. Alternatively if the different light sensitive components 2 are set on the beaming identification areas, and when the optical detection mechanisms 4 emit the beams to the beaming identification areas, the different light signals reflected or transmitted from the light sensitive components 2 on the different beaming identification areas are sent to the optical detection mechanism 4.

As shown in FIGS. 10 to 13, the additive dispensing apparatus provided by the embodiment includes the light sensitive component 2 arranged on the liquid storage box 1 and the optical detection mechanism 4 correspondingly arranged in the additive dispensing apparatus. When it is determined that the liquid storage box 1 is inserted into the accommodating portion 3 of the additive dispensing apparatus, the light emitting part 41 of the optical detection mechanism 4 emits the beams to the light sensitive component 2 on the liquid storage box 1. The type of additive in the liquid storage box 1 is determined according to the beam information received by the light receiving part 42 of the optical detection mechanism 4. The present disclosure can realize to automatically identify the type of additive in the liquid storage box 1 by means of electrical detection and without contact, and it is achieved high identification efficiency and identification accuracy.

In this embodiment, the additive dispensing apparatus can be any existing structure to dispense the additive in the liquid storage box 1 placed in the accommodating portion 3. For example: the additive dispensing apparatus is provided with at least one liquid storage box 1 for holding additive. Via the dispensing unit each of the liquid storage boxes 1 is connected with the waterway of the washing machine for feeding water into the drum, so that each additive dispensing apparatus is controlled to dispense at least one additive into the drum accordingly.

In this embodiment, the dispensing unit can be any existing apparatus that can realize to dispense additive, such as a suction pump that generates suction force to pump out additive during operation, and Venturi tube that generates a negative pressure to pump out additive by water flow, and the like.

As shown in FIGS. 10 to 13, in one embodiment, the optical detection mechanism 4 includes the light emitting part 41 and light receiving part 42 set in the accommodating portion 3. The light emitting part 41 and the light receiving part 42 are respectively arranged on the two side walls opposite with each other in the accommodating portion 3. The positions of the light emitting part 41 and the light receiving part 42 correspond to the position of the light blocking part. After the different liquid storage box 1 is installed in the accommodating portion 3, the light emitting part 41 emits the beams to all the beaming identification areas of the liquid storage box 1, and the light blocking part on the liquid storage box 1 blocks the beams emitted from the light emitting part 41 to the beaming identification area from passing through. The beams directly pass through the beaming identification area where there is no arrangement of the light blocking part. The light receiving part 42 accordingly receives the beams emitted from different arrangements.

Furthermore, the light emitting part 41 is arranged on one side wall of the accommodating portion 3, which is used to emit the beams, and on the side wall opposite to the one side wall there is the light receiving part 42 receiving the beams. The liquid storage box 1 is provided with the light blocking part for blocking or absorbing the beams. According to the points of the beams received by the light receiving part 42, the type of additive in the liquid storage box 1 is identified.

Specifically, in the inserting direction of the liquid storage box 1, the light blocking part is set as multiple of the light blocking protrusions on the front wall 11 of the liquid storage box 1. The liquid storage boxes with different types of additives are provided with the different quantity and/or position of the light blocking protrusions. The different arrangements of the light blocking protrusions indicate correspondingly different types of additives in the liquid storage boxes 1.

Furthermore, the light blocking protrusions are linearly arranged and distributed in the longitudinal direction of the front wall 11 of the liquid storage box 1. There are multiple of the light emitting part 41 and the light receiving part 42. The positions of the light emitting part 41 and the light receiving part 42 correspond to the position of the light blocking protrusions by one-to-one. The light emitting part 41 and the light receiving part 42 are respectively distributed on the two inner side walls, located near the left side and right side of the liquid storage box 1, of the accommodating portion 3 in the longitudinal direction. The light emitting parts 41 and the light receiving parts 42 can cover all the light blocking protrusions set on different liquid storage boxes 1 in the accommodating portion 3.

Further, the arrangements of the light blocking protrusions are different for the liquid storage boxes 1 stored different types of additives. After the liquid storage box 1 is installed in the accommodating portion, the light blocking protrusions can block the beams from passing through. The light receiving part 42 is arranged on the side wall opposite to the light emitting part 41. The type of the liquid storage box 1 can be identified according to the arrangement of the beams received by the light receiving part 42.

Preferably, the additive dispensing apparatus also includes the identification unit. The type of additive in the liquid storage box 1 is determined by the identification unit based on the beam information received by the light receiving part.

The identification unit is integrated on the additive dispensing apparatus, or arranged the outside of the additive dispensing apparatus. The identification unit can obtain the beam information received by the light receiving parts, and infer the position and/or quantity of the light sensitive component 2 based on the beam information obtained. The position and/or quantity information are compared with the pre-storage database to determine the type of additive in the liquid storage box 1 corresponding to the information of the light sensitive component 2, so that the type of additive in the liquid storage box 1 is accurately determined.

Specifically, as shown in FIGS. 11 to 13, the liquid storage box 1 has the beaming identification areas of No. The number of the optical detection mechanism 4 is No. The light blocking protrusions are correspondingly arranged on the beaming identification areas in different combinations. The quantity or/and the position of the light blocking protrusions correspondingly indicate the type of additive in the liquid storage box 1.

This embodiment is described in detail in $N_0$=8 as an example. As shown in FIG. 11, eight of the beaming identification areas, where the light blocking protrusions are arranged, indicate the type of additive in the liquid storage apparatus being detergent. The eight of the beaming identification areas include the first, second, third . . . eighth beaming identification areas from top to bottom. As shown in FIG. 12, the light blocking protrusions are respective arranged on the first, third, fifth, seventh, and eighth beaming identification areas, which indicates the type of additive in the liquid storage box 1 is softener. As shown in FIG. 13, the light blocking protrusions are respective arranged on the fifth, sixth, seventh, eighth beaming identification areas, which indicates the type of additive in the liquid storage box 1 is disinfectant. When the liquid storage box 1 is placed in the accommodating portion 3, the light emitting parts 41 of eight of the optical detection mechanisms emit the beams to the eight of the beaming identification areas respectively, and the beams are blocked by the light blocking protrusions at the beaming identification areas.

As shown in FIG. 11, if the light receiving parts 42 of the optical detection mechanisms 4 do not receive the light signal, the type of additive in the liquid storage box 1 is determined as a detergent.

As shown in FIG. 12, if the light receiving parts 42 of the optical detection mechanisms 4 corresponding to the second, fourth, and sixth beaming identification areas receive the light signal, and the light receiving parts 42 of the optical detection mechanisms 4 corresponding to the first, third, fifth, seventh and eighth beaming identification areas do not receive the light signal, the type of additive in the liquid storage box 1 is determined as a softener.

As shown in FIG. 13, if the light receiving parts 42 of the optical detection mechanisms 4 corresponding to the first, second, third and fourth beaming identification areas receive the light signal, and the light receiving parts 42 of the optical detection mechanisms 4 corresponding to the fifth, sixth, seventh and eighth beaming identification areas do not receive the light signal, the type of additive in the liquid storage box 1 is determined as a disinfectant.

The light sensitive component 2 on the liquid storage box 1 in this embodiment is the light blocking protrusion on the liquid storage box 1. When the liquid storage box 1 is installed in the accommodating portion 3, the light blocking protrusion of the liquid storage box 1 blocks the beams emitted by the light emitting part 41 corresponding to the light blocking protrusion from passing through, and the light receiving part 42 of the optical detection mechanism 4 accordingly receives the beams of different arrangements. Based on the information of position and/or quantity of the beams received by the light receiving part 42, the type of additive in the liquid storage box 1 can be determined. The light blocking protrusion is as the light sensitive component 2, of which the structure is simple and is easy to operate. Through different arrangements of the light blocking protrusions, the type of additive in the liquid storage box 1 can be accurately identified. Thereby the type of the additive in the liquid storage box 1 is automatically and accurately identified, which is the significant technological progress.

In another embodiment, the light sensitive component 2 has the reflection surface, or the light sensitive component 2 is identification labels with different colors arranged on the outer wall of the liquid storage box 1. The optical detection mechanism 4 includes the light emitting part 41 and the light receiving part 42 arranged on the same side wall of the accommodating portion 3. The positions of the light emitting part 41 and the light receiving part 42 correspond to the positions of the light sensitive component 2 by one-to-one. The light receiving part 42 receives the beams reflected by the light sensitive component 2 arranged on the corresponding position. After the liquid storage box 1 is installed in the accommodating portion 3, the light sensor component 2 on different storage box 1 reflects the beams on the light receiving part 42 at the corresponding position.

Specifically, the light emitting structures with different arrangements are arranged on the positions of the liquid storage box 1 corresponding to the light emitting parts 41 of the accommodating portion. The light receiving parts 42 are arranged on the same side with the light emitting parts 41 of the accommodating portion. The type of additive in the liquid storage box 1 is determined according to the arrangement of the beams received by the light receiving parts 42.

Preferably, the additive dispensing apparatus also includes the identification unit. The type of additive in the liquid storage box 1 is determined by the identification unit based on the reflecting beam received by the light receiving part.

The identification unit is integrated on the additive dispensing apparatus, or arranged the outside of the additive dispensing apparatus. The identification unit can obtain the reflecting beam information received by the light receiving parts, and infer the position and/or quantity of the light sensitive components 2 based on the reflecting beam information obtained. The position and/or quantity information are compared with the pre-storage database to determine the type of additive in the liquid storage box 1 corresponding to the information of the light sensitive component 2, so that the type of additive in the liquid storage box 1 is accurately determined.

In this embodiment, the identification labels with different colors arranged on the liquid storage box 1 are as the light sensitive component 2, or the light sensitive component 2 has the reflection surface. When the liquid storage box 1 is installed in the accommodating portion 3, the beam emitted by the light emitting part 41 is reflected by the light sensitive component 2, and the reflecting beams get to the light receiving part 42 on the corresponding position. The type of additive in the liquid storage box 1 can be determined based on the position, quantity, and/or frequency information of the reflecting beams received by the light receiving part 42. Using the information of the reflecting beams received by the light receiving part 42, the type of additive in the liquid storage box 1 is determined. The method for determining the type of additive in the liquid storage box 1 by means of the optical detection and identification is concise. The arrangements of the light sensitive component 2, the light emitting part 41 and the light receiving part 42 are more flexible.

As shown in FIG. 13, this embodiment also describes a method for identifying the type of additive in the above-mentioned additive dispensing apparatus. When the liquid storage box 1 is inserted into the accommodating portion 3 of the additive dispensing apparatus, the light emitting part 41 of the optical detection mechanism 4 emits the beams to the light sensitive component 2 on the liquid storage box 1. The type of additive in the liquid storage box 1 is determined according to the beams received by the light receiving part 42 of the optical detection mechanism 4.

Figure 15:
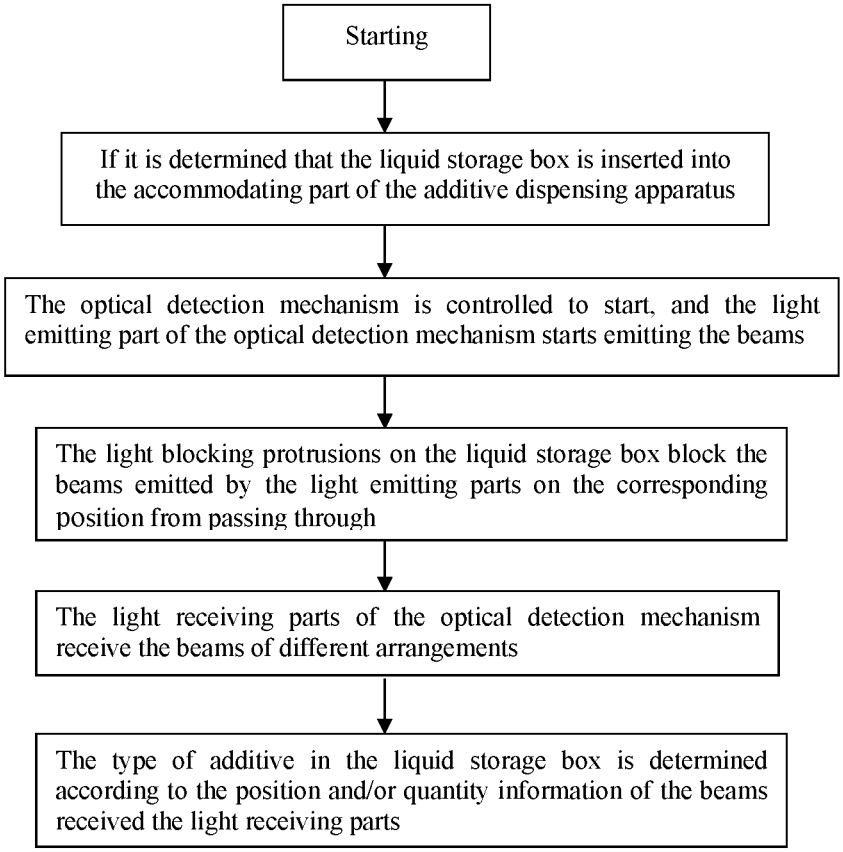
FIG. 15 is the flow diagram of the first method for identifying the type of additive according to another embodiment of the disclosure.

As shown in FIG. 15, in the identification method, when the liquid storage box 1 is inserted into the accommodating portion 3 of the additive dispensing apparatus, the optical detection mechanism 4 starts, and the light emitting part 41 of the optical detection mechanism 4 starts emitting the beams. The light blocking protrusions on the liquid storage box 1 block the beams emitted by the light emitting parts 41 on the corresponding position from passing through. The light receiving parts 42 of the optical detection mechanism 4 receive the beams of different arrangements. The type of additive in the liquid storage box 1 is determined according to the position and/or quantity information of the beams received the light receiving parts 42.

Figure 16:
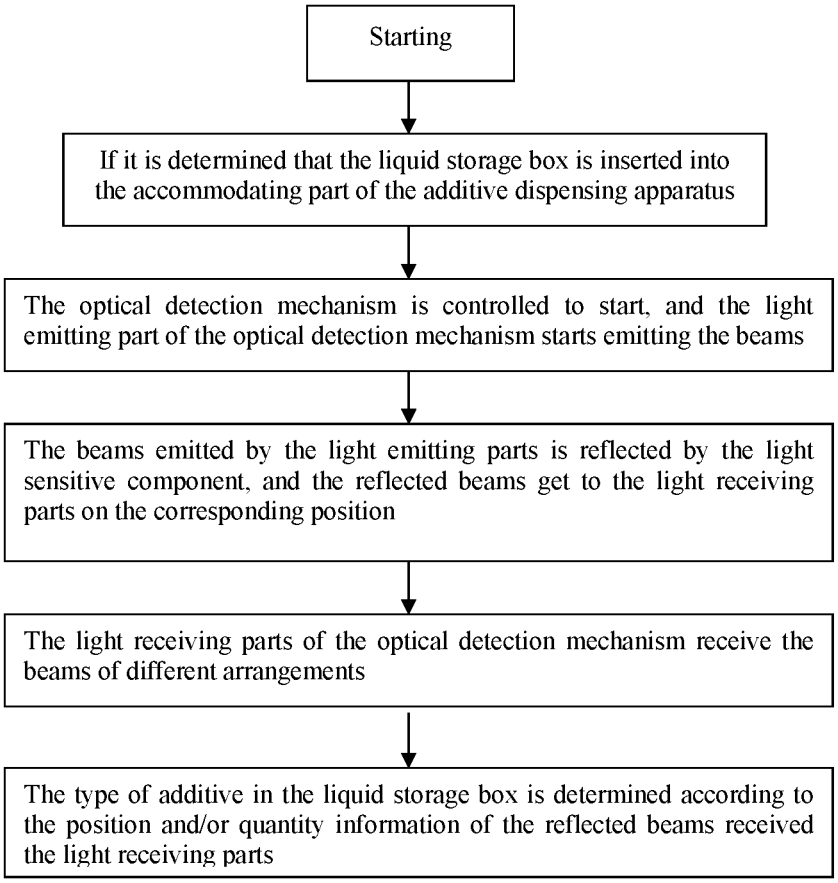
FIG. 16 is the flow diagram of the second method for identifying the type of additive according to another embodiment of the disclosure.

As shown in FIG. 16, in other identification method, when the liquid storage box 1 is inserted into the accommodating portion 3 of the additive dispensing apparatus, the optical detection mechanism 4 starts, and the light emitting part 41 of the optical detection mechanism 4 starts emitting the beams. The beams emitted by the light emitting parts 41 is reflected by the light sensitive component 2, and the reflected beams get to the light receiving parts 42 on the corresponding position. The type of additive in the liquid storage box 1 is determined according to the position, quantity and/or frequency information of the reflected beams received the light receiving parts 42.

In the disclosure, the type of additive in the liquid storage box 1 can be accurately determined by the method for determining the type of additive. During the following using process, the correct type of additive after being determined is accurately dispensed. So, the problem is solved that the existing additive dispensing apparatus cannot automatically detect whether the type of additive in the liquid storage box 1 is correct.

Embodiment 3

This embodiment describes a laundry treatment device. The laundry treatment device can be any one existing apparatus with the function of treating laundry, such as: a pulsator-type washing machine, a drum washing machine, a dryer, a care machine, an ironing machine, and a disinfection machines, etc. The laundry treatment device in the embodiment of the present disclosure can be an ordinary washing machine, which has a tub for being used for holding water and having the function of the outer tub. The laundry treatment device may be a non-clean washing machine having an inner tub without holes. The inner tub of the non-clean washing machine is a water holding tub, which has a function of the inner and outer tubs, and has a dewatering hole, and a discharge port being controlled to be open or close. The other washing assembly is arranged in the tub for stirring washing water and washing the laundry, such as pulsator, stirring column, and so on.

In this embodiment, the laundry treatment device is provided with the additive dispensing apparatus described by the foregoing. The liquid storage apparatus 1 is identified by the identification method described in the above embodiment, further the type of additive in the liquid storage box 1 is determined. In the laundry treating program installed in the laundry treatment device, the additive identified is accurately dispensed in the tub of the laundry treatment device.

At the same time, in this embodiment, the additive dispensing apparatus described in the above embodiment can be installed on the outside of the laundry treatment device. That is, the additive dispensing apparatus is installed on the laundry treatment device, and located on the outside of the laundry treatment device. For example, the additive dispensing apparatus can be fixed on the outer wall of the shell of the laundry treatment device. Alternatively, as an example, the additive dispensing apparatus is connected to the water inlet pipe of the laundry treatment device. The additive is dispensed in the water inlet pipe, and dispensed in the tub of the laundry treatment device by utilizing water entering in the laundry treatment device.

The embodiments merely describe preferred embodiments of the present disclosure, rather than limiting the concept and scope of the present disclosure. The preferred embodiments are disclosed above, and not used for limiting the present disclosure. Under the premise of not departing from the design idea of the present disclosure, various changes and improvements made to the technical solution of the present disclosure by those skilled in the art, such as simple amendment, equal change and modify according concept of the present disclosure, shall all fall within the protection scope of the present disclosure. The implementing solutions in the above embodiments can be further combined or substituted.

What is claimed is:

1. An additive dispensing apparatus, comprising a liquid storage box and an accommodating portion for placing the liquid storage box, wherein, the liquid storage box has a closed chamber for storing additive, marking conductive components are arranged on the liquid storage box, any one element or a combination of elements selected from a group consisting of the quantity, position, shape, and resistance of the marking conductive components on the liquid storage box indicates correspondingly a type of additive in the liquid storage box, a plurality of identification conductive components are arranged in the accommodating portion, and all of the identification conductive components cover projections of the marking conductive components of different liquid storage boxes on the accommodating portion;

each of the marking conductive components of the liquid storage box corresponds to and is spaced apart from one of the identification conductive components in the accommodating portion, so as to form a capacitance for correspondingly indicating the type of additive in the liquid storage box.

2. The additive dispensing apparatus according to claim 1, wherein, the marking conductive components are marking conductive metal sheets arranged on the liquid storage box, there is difference in the quantity, position, shape, thickness, and/or material of the marking conductive metal sheet on the liquid storage box for storing different types of additive.

3. The additive dispensing apparatus according to claim 2, wherein, the marking conductive metal sheets are arranged on an outer surface of the liquid storage box;

or, the marking conductive metal sheets are embedded in the inside of a box wall constituting the closed chamber of the liquid storage box;

or, the marking conductive metal sheets are provided on the inner surface of the box wall constituting the closed chamber of the liquid storage box.

4. The additive dispensing apparatus according to claim 3, wherein, the liquid storage box has an insertion end for being connected with a dispensing apparatus; a protrusion is arranged on the insertion end of the liquid storage box, and is extended in an insertion direction of the liquid storage box; the marking conductive metal sheets are arranged on one protrusion or more protrusions; and the marking conductive metal sheets are is arranged at the end of the protrusion, and/or buried inside the protrusion.

5. The additive dispensing apparatus according to claim 4, wherein, the insertion end of the liquid storage box has a plurality of setting positions in multiple rows and columns, and the marking conductive metal sheets are arranged on one setting position or the setting positions;

the marking conductive metal sheets are perpendicular to the insertion direction of the liquid storage box.

6. The additive dispensing apparatus according to claim 1, wherein, the marking conductive components are connected to a first connection terminal via a connection circuit arranged in parallel; and the first connection terminal is used for connecting with a second connection terminal in the corresponding accommodating portion of the additive dispensing apparatus.

7. The additive dispensing apparatus according to claim 1, wherein, the identification conductive components are identification conductive metal sheets provided in the accommodating portion, the identification conductive metal sheets are arranged on the inner wall of the accommodating portion, or embedded in the interior of the accommodating portion;

marking conductive metal sheets being as the marking conductive components on the liquid storage box are arranged parallel to and spaced apart from the identification conductive metal sheets in a one-to-one relationship, and the identification conductive metal sheets are provided at the projections of the marking conductive components on the accommodating portion.

8. The additive dispensing apparatus according to claim 7, wherein, a projection area of the marking conductive metal sheet of the liquid storage box on the surface and/or inside of the accommodating portion along a direction vertical to the marking conductive metal sheet is as a projection position.

9. The additive dispensing apparatus according to claim 7, wherein, there is an interval space between the marking conductive metal sheet and the identification conductive metal sheets, in the interval space, a box wall of the liquid storage box and/or a cavity wall of the accommodating portion is made of non-conductive material.

10. The additive dispensing apparatus according to claim 7, wherein, the accommodating portion has a bottom wall being in contact with the insertion end of the liquid storage box, and the bottom wall is provided with grooves for allowing the protrusions of the insertion ends of different liquid storage boxes to be inserted, the bottom of each of the grooves is provided with the identification conductive metal sheets perpendicular to the insertion direction of the liquid storage box.

11. The additive dispensing apparatus according to claim 1, wherein, all the identification conductive components are respectively connected to a second connection terminal via a connecting circuit arranged in parallel, and the second connection terminal is connected with a first connection terminal arranged on the liquid storage box being inserted in the accommodating portion of the additive dispensing apparatus.

12. The additive dispensing apparatus according to claim 11, wherein, an enhancing voltage unit is arranged on a connecting circuit to apply voltage on the capacitance formed by the identification conductive component and the marking conductive component.

* * * * *